United States Patent [19]

Pahnke et al.

[11] Patent Number: 5,003,886

[45] Date of Patent: Apr. 2, 1991

[54] PROJECTILE FOR COMBATTING ACTIVELY AND PASSIVELY RECTING ARMOR

[75] Inventors: Klaus-Dieter Pahnke, Hilden; Rolf Holl; Wilfried Becker, both of Düsseldorf, all of Fed. Rep. of Germany

[73] Assignee: Rheinmetall GmbH, Düsseldorf, Fed. Rep. of Germany

[21] Appl. No.: 81,801

[22] Filed: Jul. 29, 1987

Related U.S. Application Data

[63] Continuation-in-part of Ser. No. 35,113, Mar. 18, 1987, abandoned.

[30] Foreign Application Priority Data

Mar. 19, 1986 [DE] Fed. Rep. of Germany ..... 3609092

[51] Int. Cl.[5] ..... F42B 14/06; F42B 12/68

[52] U.S. Cl. ..... 102/521; 102/501; 102/504; 102/703; 244/3.24

[58] Field of Search ..... 102/501, 504, 517–523, 102/703; 244/3.1, 3.12, 3.24, 3.27, 3.28, 3.29, 3.3

[56] References Cited

U.S. PATENT DOCUMENTS

| | | | |
|---|---|---|---|
| 1,181,203 | 5/1916 | Alard | 244/3.28 |
| 3,086,467 | 4/1963 | Gallagher | 244/3.1 |
| 3,672,304 | 6/1972 | Rogers et al. | 102/501 |
| 3,747,533 | 7/1973 | Rossmann | 102/529 |
| 4,516,502 | 5/1985 | Klein | 102/523 |
| 4,524,697 | 6/1985 | Backer et al. | 102/517 |
| 4,559,876 | 12/1985 | Bocker et al. | 102/520 |
| 4,648,567 | 3/1987 | Maudal | 244/3.24 |
| 4,714,024 | 12/1987 | Bocker et al. | 102/521 |

FOREIGN PATENT DOCUMENTS

| | | |
|---|---|---|
| 3127002 | 1/1983 | Fed. Rep. of Germany . |
| 3207220 | 9/1983 | Fed. Rep. of Germany . |
| 2128301 | 4/1984 | United Kingdom . |

*Primary Examiner*—Harold J. Tudor

*Attorney, Agent, or Firm*—Spencer & Frank

[57] ABSTRACT

A sabot-projectile arrangement adapted for being ejected from a gun barrel for the purpose of combatting actively and passively reacting armor. The arrangement comprises first and second projectiles, each having a different coefficient of air resistance ($c_w$). A discarding sabot is comprised of segments which define a receptacle for accommodating the first and second projectiles with their longitudinal axes flush behind one another in order to follow one another in a spaced relationship on a common trajectory when the sabot-projectile arrangement is fired from a gun. Form locking means defines a form locking connection between the receptacle and each of the projectiles. The form locking connection existing between the leading first projectile disposed in the receptacle and the segments of the sabot are released earlier than when the segments are separated from the second projectile after the sabot-projectile arrangement leaves the gun barrel. Delay means cause the second projectile to be delayed with respect to the first projectile when the segments are separated for creating a desired distance between the projectiles within narrow distancing limits within which there exists axial aerodynamic coupling between the projectiles. An actuatable device is provided for varying the $c_w$ coefficient of at least one of the projectiles during flight so that the aerodynamic coupling between the projectiles is maintained within the distancing limits.

6 Claims, 4 Drawing Sheets

PROJECTILE FOR COMBATTING ACTIVELY AND PASSIVELY REACTING ARMOR

CROSS REFERENCE TO RELATED APPLICATION

This application is a continuation-in-part of applicant's copending U.S. application Ser. No. 07/035,113, filed Mar. 18th, 1987, now abandoned.

BACKGROUND OF THE INVENTION

The present invention concerns a sabot-projectile arrangement which is ejected from a gun barrel for the purpose of combatting actively and passively reacting armor, and more particularly to a projectile which includes a first and a second projectile, each having a different coefficient of air resistance ($c_w$), a discarding sabot composed of segments which are discarded after the projectile leaves a gun barrel, such segments defining a receptacle for accommodating the first and the second projectile with their longitudinal axes flush behind one another in order to follow one another in a spaced relationship on a common trajectory; and form locking means defining a form locking connection between the receptacle and each of the two projectiles, wherein the form locking connection existing between the leading first projectile disposed in the receptacle and the segments of the sabot is released earlier than when the segments are separated from the trailing second projectile after the sabot-projectile arrangement leaves a gun barrel.

An arrangement of this type is disclosed in German Offenlegungsschrift No. 3,207,220, corresponding to U.S. Pat. No. 4,516,502. This publication also describes means for assuring that the kinetic energy projectile disposed in the front, when seen in the direction of flight, remains in front even during free flight of the kinetic energy projectiles. For this purpose, the two types of projectiles differ in their respective coefficient of air resistance ($c_w$). The leading projectile is intended to initiate the active or passive reaction in a target area and thus assure that the second projectile can become effective at the target substantially without interference.

This known arrangement has the drawback that the axial spacing between the two projectiles increases over the entire trajectory. Interference impressed on the one and/or the other of the two projectiles strongly influences whether the projectile flying in second position will indeed hit the target area in which the preceding projectile has done its preparatory work.

German Offenlegungsschrift No. 3,127,002 corresponding to U.S. Pat. No. 4,524,000 discloses a sabot-projectile arrangement projectiles in which fly one behind the other and whose $c_w$ coefficients can be adapted to one another along the trajectory, with the projectiles being connected together by means of a cable. This arrangement requires considerable manufacturing expenses and is subject to malfunction.

SUMMARY OF THE INVENTION

It is an object of the present invention to provide a sabot-projectile arrangement of the above type in which the projectile flying in the second (trailing) position will become effective in the closely defined target area in which the front projectile was previously active.

The above and other objects are accomplished according to the invention in the context of a projectile as first described above wherein the sabot-projectile arrangement further includes:

delay means for delaying the second projectile with respect to the first projectile when the segments are separated for creating a desired distance between the two projectiles within narrow distancing limits within which there exists an axial aerodynamic coupling between the two projectiles; and actuatable means for varying the $c_w$ coefficient of at least one of the two projectiles during flight, wherein actuation of the actuatable means causes the aerodynamic coupling between the projectiles to be maintained within the distancing limits.

Advantageously, the means provided by the invention as a solution of the problem at hand are very reliable and involve little expense.

BRIEF DESCRIPTION OF THE DRAWINGS

The invention will be described in greater detail below for embodiments which are illustrated in the drawings, wherein.

DESCRIPTION OF THE PREFERRED EMBODIMENTS

For purposes herein, the projectile intended to be leading in flight will be called the activator and the projectile intended to follow will be called the penetrator, regardless of whether the target against which the sabot-projectile arrangement according to the invention is used is an actively or passively reacting target.

Figure 1:
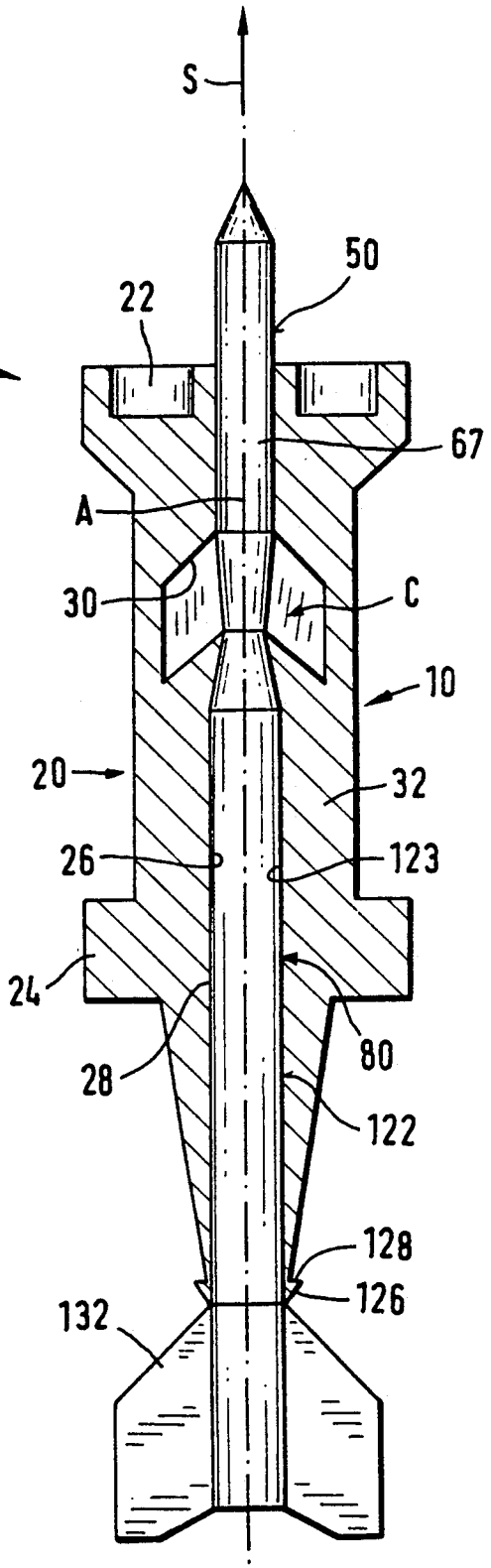
FIG. 1 is a side elevational and partially sectional view of a sabot-projectile arrangement according to the invention in the state in which it passes through a gun barrel.

According to FIG. 1, a sabot-projectile arrangement 10 having a longitudinal axis A is provided with a discarding sabot 20 composed of segments 32, an air pocket 22 at the front, a guide flange 24, e.g., at its rear, and a central receptacle 26 for an activator 50 as well as a penetrator 80 whose axis is flush with and arranged behind that of the activator 50. Receptacle 26 has associated form-locking means 28 (for example internal threads) which are not shown in detail and which correspond with form-locking means 67, 123 on the circumference (likewise not shown in detail) of the two projectiles 50 and 80, respectively.

A recess 30 is provided in the sabot 20 for a stabilizing guide assembly 72 of activator 50. Penetrator 80 has a stabilizing guide assembly 132, in front of which, when seen in the axial direction, there are provided segment holders 126 which project radially beyond the circumferential face 122 of penetrator 80. The sabot-Projectile arrangement 10 is assumed to move through a gun barrel (not shown) in the direction of the arrow S.

Figure 2:
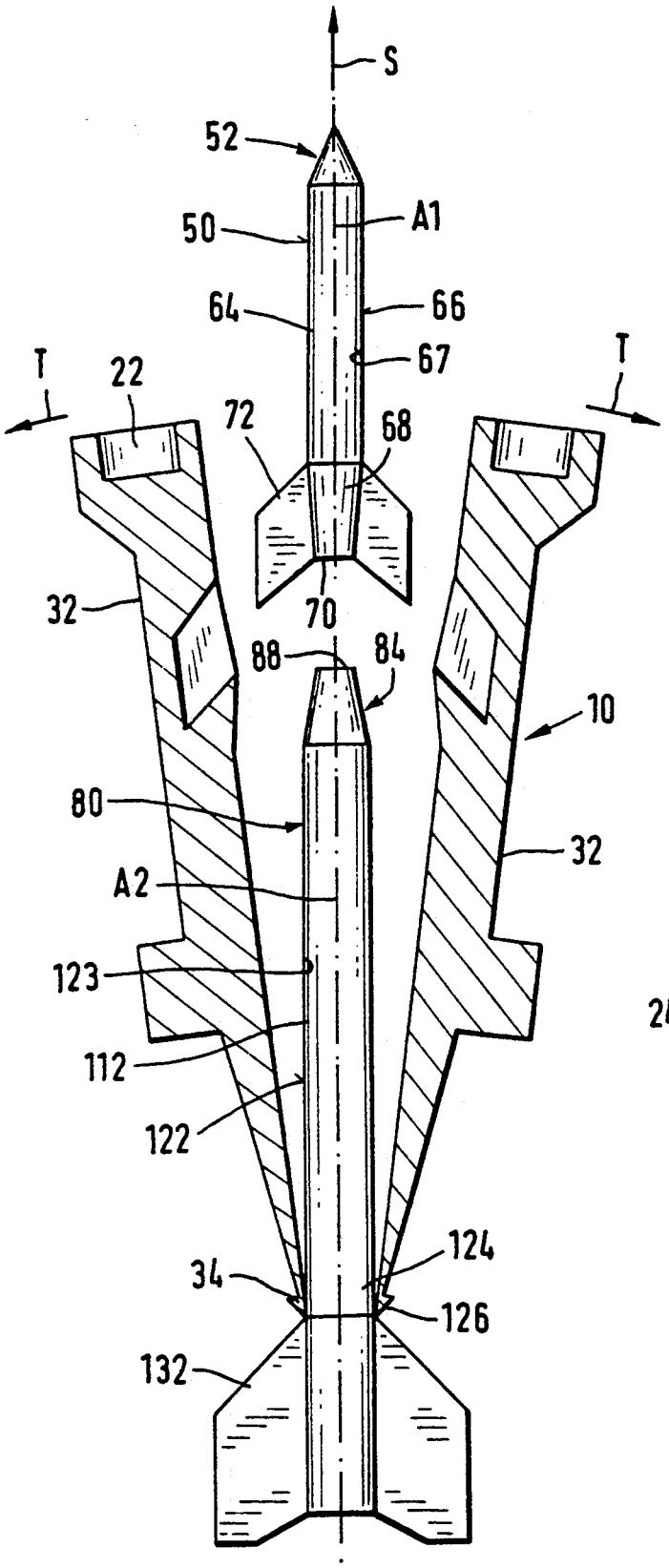
FIG. 2 shows the arrangement of FIG. 1 as it passes out of the gun barrel (not shown), with the discarding sabot segments beginning to separate under the effect of the air flowing toward it from the front.

FIG. 2 shows sabot-projectile arrangement 10 of FIG. 1 after it has substantially passed through a gun muzzle, which is not shown. Under the effect of the air streaming toward them from the front, segments 32 pivot in the direction of arrows T, with the tail faces 34 being supported on frontal faces 128 of segment holders 126 (see also FIGS. 7, 8 and 9). The form-locking connection between segments 32 and activator 50 is thus released so that activator 50 can move unimpededly in the direction of arrow S. With the pivoting movement of segments 32, a separation jolt acts on penetrator 80 and inhibits its forward movement. According to the velocity drop of penetrator 80, a space will now develop between a tail face 70 of activator 50 and a leading delimiting face 88 of penetrator 80. The magnitude of such a space can be determined within close limits by controlling the process until segments 32 are completely separated from penetrator 80. The further development is based on the realization obtained from numerous experiments that an aerodynamic coupling must exist between the two projectiles 50 and 80 in the axial direction (i.e. along the trajectory) as long as the tip region 84 of penetrator 80 is disposed within the wake at the tail end of activator 50 and is able to follow the latter without impediment.

Surprisingly, axial aerodynamic coupling can be realized with simple means adapted to the separating jolt. The distancing behavior between activator 50 and penetrator 80 can be controlled by intentionally changing the $c_w$ coefficient of one or the other of the two projectiles 50, 80 during flight. In contrast to the above cited prior art, the distance can be held within close limits and thus penetrator 80 can also be prevented from drifting transversely to the direction of flight and to the trajectory of activator 50. The resulting aerodynamic coupling will produce the desired one-behind-the-other flight of the two projectiles 50 and 80 even if the flight of penetrator 80 is interfered with, for example due to faulty release of segments 32 of discarding sabot 20.

Figures 3, 4:
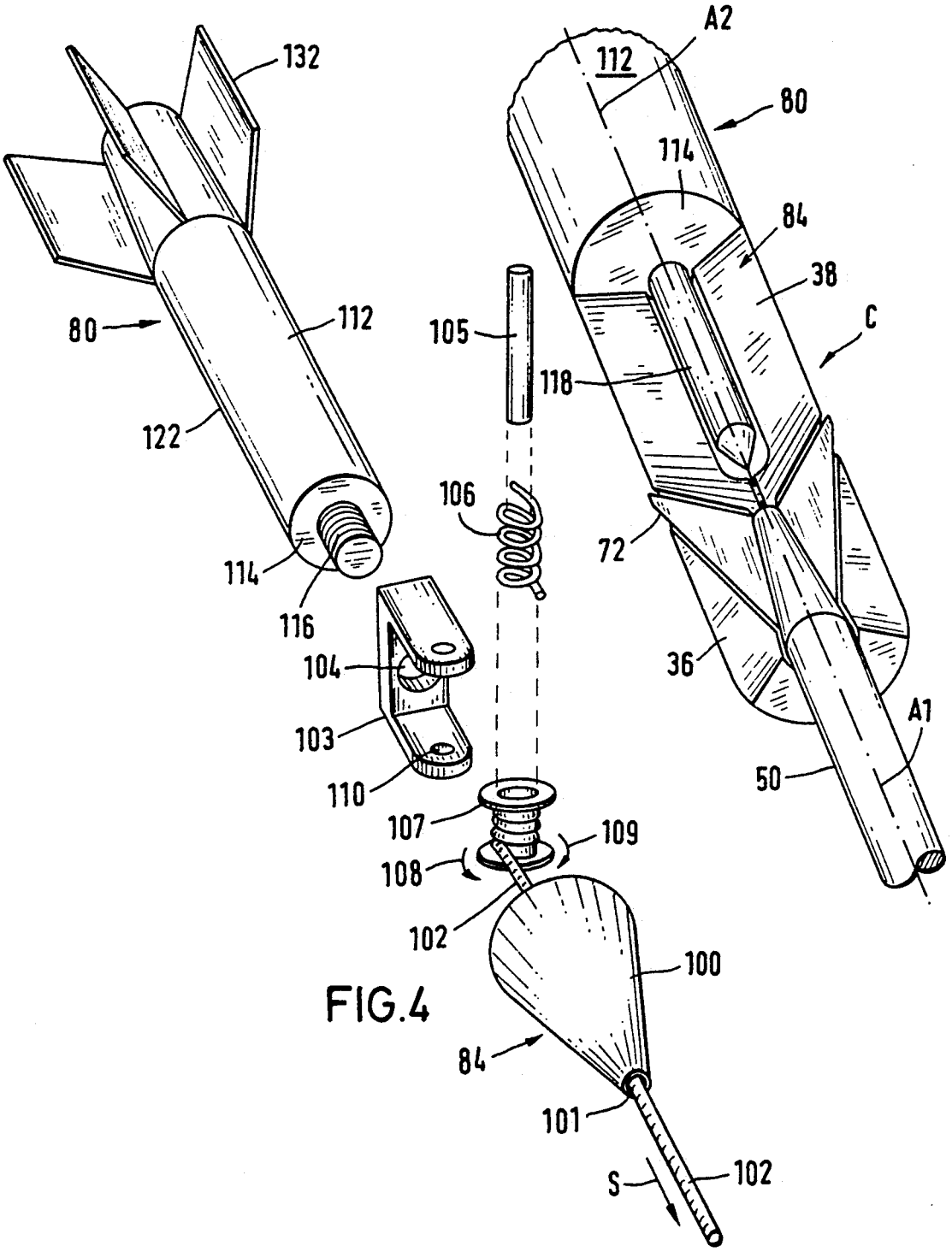
FIG. 3 is a perspective, enlarged detail view, partially in section, of structural details in the region between two exemplary projectiles before the start of separation of the discarding sabot segments.
FIG. 4 is an exploded perspective view of an embodiment of the trailing, penetrator projectile including means for additional mechanical coupling.

A significant prerequisite for the realization of axial aerodynamic coupling is the ability of the two projectiles 50 and 80 to space themselves without interference. Therefore, the arrangement in receptacle 26 of discarding sabot 20 is quite important. FIGS. 1 and 2 show one embodiment in which faces 70 and 88 form a butt joint. FIG. 3 shows another embodiment in which, due to the spike like tip 118 of penetrator 80, such a butt joint is not possible. Accordingly, segmented supporting elements 36 and 38 are provided for the projectiles which supporting elements 36, 38 remove themselves from the range of impact C of the two projectiles 50 and 80 when segments 32 of discarding sabot 20 (not shown in FIG. 3) are severed.

FIG. 4 shows an exemplary configuration of a penetrator 80 which is provided with a mechanical coupling in addition to the aerodynamic coupling with actuator 50. Body 112 of penetrator 80 is provided with a threaded bolt 116 which projects beyond a leading frontal face 114 and onto which is screwed a forked member 103 having a threaded bore 104. An arrangement composed of a cable reel 107 and a helical torsion spring 106 is held by a shaft 105 in bearing eyes 110 of forked member 103. Torsion spring 106 is arranged, in a manner not shown in detail, so that its one end is fixed to cable reel 107 and its other end is fixed to forked member 103. One end of a cable 102 is connected, in a manner not shown, with penetrator 80 in the tip region 84 of the latter, and the free end of cable 102 is wound onto cable reel 107 and fixed, in a manner not shown, in the tail section of activator 50. A circularly conical ballistic hood 100 can be connected with body 112 of penetrator 80 and serves as protection and fairing for the above described arrangement. Cable 102 here passes through a nozzle-like opening 101 in hood 100. When cable 102 is unwound (as activator 50 distances itself from penetrator 80) cable reel 107 rotates in the direction of arrow 108 and spring 106 is tensioned. This results in a restoring force in the direction of arrow 109.

Figure 6:
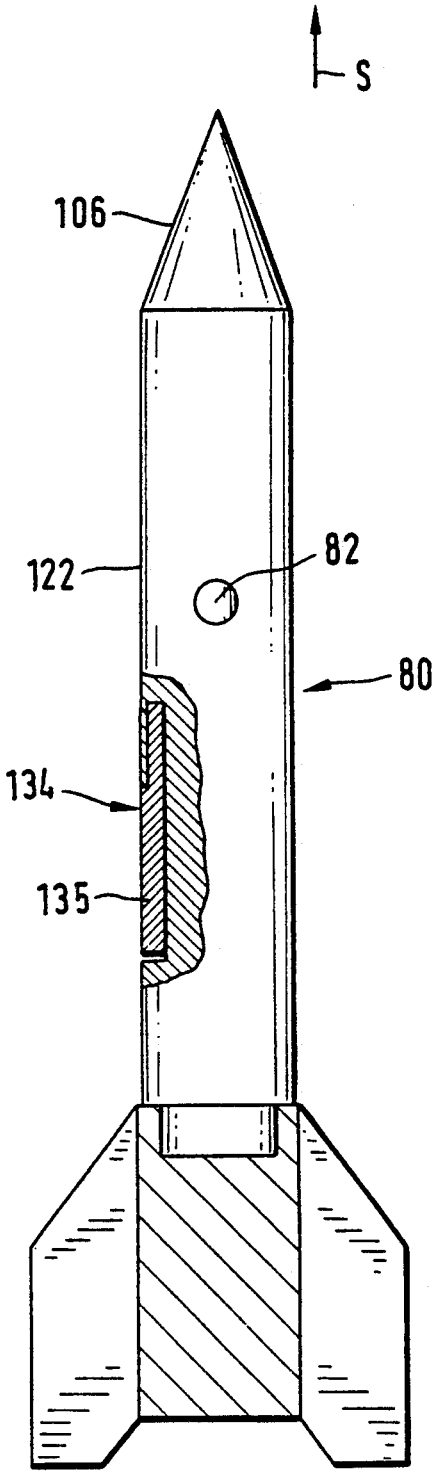
FIGS. 5 and 6 are side elevational, partially sectional views of one embodiment of a projectile (activator or penetrator) equipped with actuatable means for changing the $c_w$ coefficient on the trajectory, with such means being in different positions.
Figure 5:
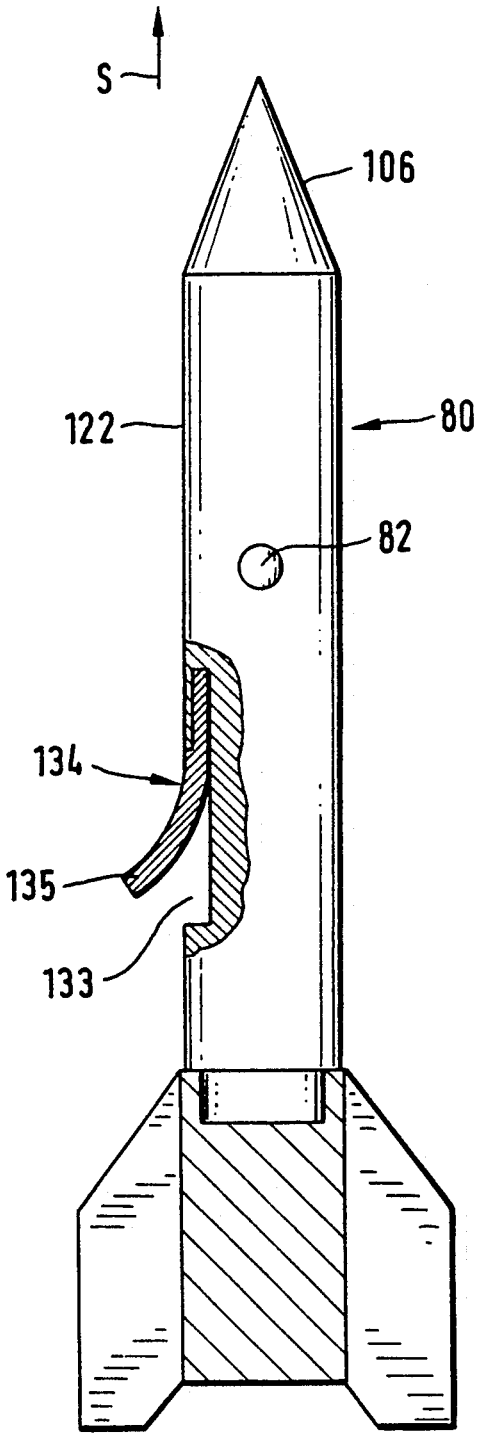

FIGS. 5 and 6 show means for varying the $c_w$ coefficient of penetrator 80 during its trajectory. These means comprise at least two spoilers arranged symmetrically in the region of circumferential face 122, although for reasons of clarity, FIGS. 5 and 6 only show one such spoiler 134. Spoiler 134 includes a strip 135 of a bimetal or a memory metal one end of which is fastened in a flat recess 133 in circumferential face 122 so that its bent free end (see FIG. 5) is able to project beyond circumferential face 122. FIG. 5 shows the state immediately after separation of segments 32 of discarding sabot 20, which is associated with an increased $c_w$ coefficient. FIG. 6 indicates that, under the influence of the friction heat of the air flowing in, strip 135 is stretched into recess 133, thus reducing the $c_w$ coefficient of penetrator 80. For reasons of aerodynamic stabilization of the trajectory, spoilers 134 are disposed behind the center of gravity 82 of the projectile when seen in the direction of flight S.

Figure 7:
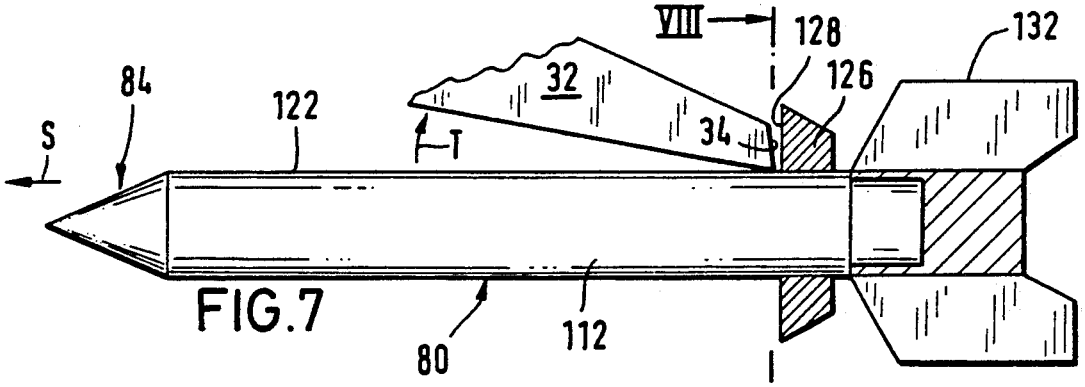
FIG. 7 is a side elevational and partially sectional view of a further embodiment of a penetrator projectile with its separating discarding sabot segments of which, for the sake of simplicity, only one is shown.

FIG. 7 illustrates the separating, pivoting movement of sabot segments 32 during the trajectory. For the sake of clarity, FIG. 7 shows only one segment 32 at penetrator 80 during its separating pivoting movement which occurs in the direction of arrow T. Tail face 34 of segment 32 remains in contact with the frontal face 128 of segment holder 126 which radially projects beyond circumferential face 122 until the segment is completely severed. Structural measures not shown here (see British Pat. No. 2,128,301, particularly at FIG. 9 and corresponding description, incorporated herein by reference) can be employed to precisely determine the severing angle which when exceeded causes segment 32 to finally lose contact with penetrator 80. The magnitude of the separation jolt which brakes penetrator 80 can be determined with sufficient accuracy.

Figure 8:
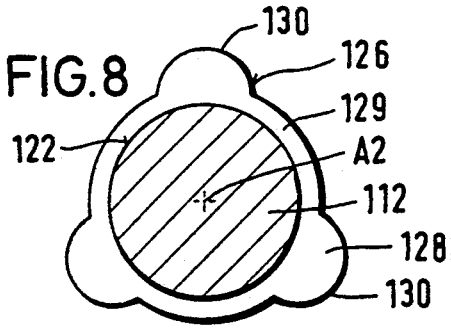
FIG. 8 is a sectional view along line VIII—VIII of FIG. 7.

FIG. 8 shows a configuration of segment holder 126 of FIG. 7 which includes another mechanism for changing the $c_w$ coefficient during trajectory. A ring 129 intimately follows circumferential face 122. Three projections 130 are associated with segments 32 (three in this case) of discarding sabot 20. The result is a high $c_w$ coefficient of penetrator 80. The $c_w$ coefficient can be reduced during trajectory by making segment holder 126 (at least in part) of a material which loses its shape and thus loses contact with penetrator 80 under the influence of the air flowing opposite to direction S as a result of the friction heat (for example due to heating and melting). Here again, reference is made to the already mentioned British Pat. No. 2,128,301.

Figure 9:
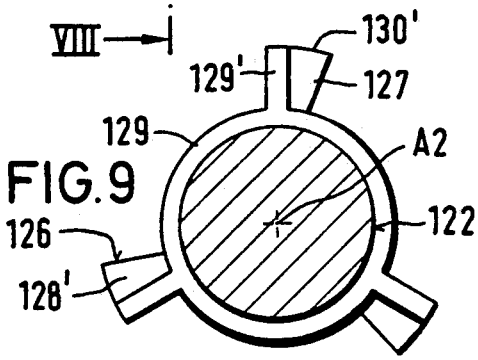
FIG. 9 is a sectional view showing a modification of the sectional view corresponding to that of FIG. 8.

A variation of segment holder 126 is shown in FIG. 9. Narrow radial projections 129', fixed to ring 129 are provided to assure a sufficiently large frontal face 128' and are enlarged by a respective lateral region 127. Again, a material of the type mentioned in connection with FIG. 8 is suitable for this purpose. Advantageously, radial projections 129' remain unchanged, once regions 127 are removed, and take over the function of the otherwise customary stabilization guide mechanism.

Figure 10A:
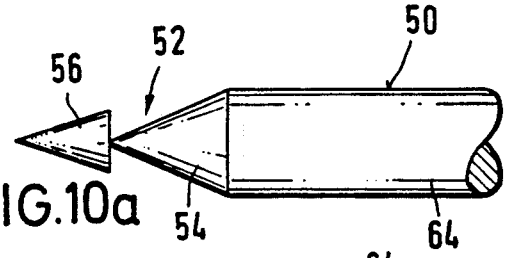
FIGS. 10*a* to 12*b* show the tip regions of projectiles having actuatable means for varying the $c_w$ coefficient, with the figures bearing the letter a showing the state before actuation of the means and those bearing the letter b showing the corresponding state after actuation of the means.
Figure 10B:
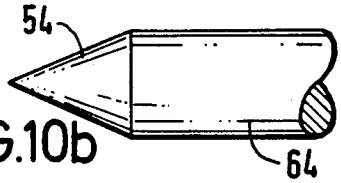
Figure 11A:
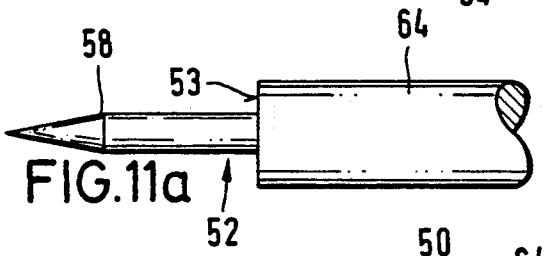
Figure 11B:
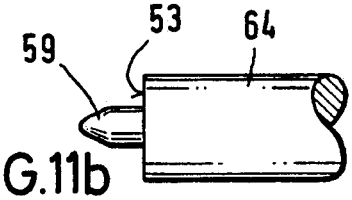
Figure 12A:
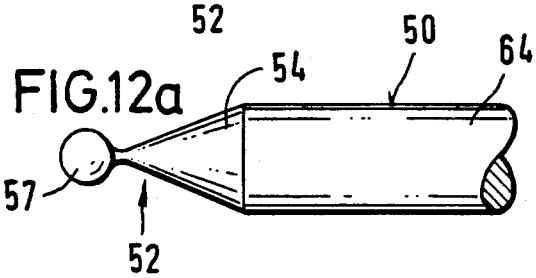
Figure 12B:
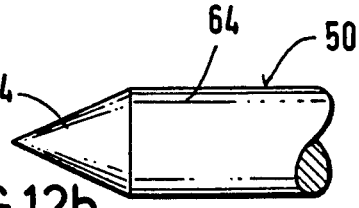
Figure 13A:
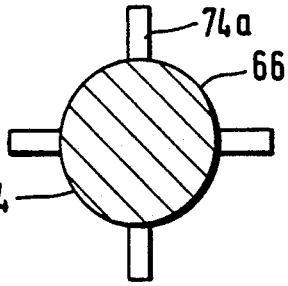
FIGS. 13*a* and 13*b* are sectional views of a projectile in which the means for varying the $c_w$ coefficient are arranged in the circumferential region, with FIG. 13*a* illustrating the view before actuation and FIG. 13*b* the view after actuation.
Figure 13B:
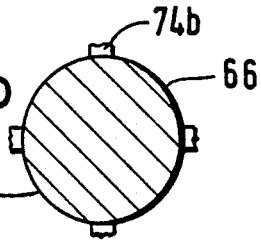

The $c_w$ coefficient of the actuator 50 can be changed during trajectory as shown, for example, by the three embodiments of FIGS. 10 to 12 wherein the tip region 52 of an activator 50 is shown, respectively, in the form of a circular cone 56, a spike 58 (at least part of it) and a ball 57, each tip being made of a material having a low softening and melting temperature. In the embodiments according to FIGS. 10*a*, 10*b*, and 12*a*, 12*b*, the respective $c_w$ coefficient is reduced during transition from the state shown in the figure bearing the letter a to the state in the figure bearing the letter b. The reverse is true in the embodiment according to FIG. 11 where spike 58 is reduced to a remainder 59. Finally, FIG. 13*a* shows radial projections 74*a* which, according to FIG. 13*b*, are reduced in size at least to remainders 74*b* and result in a reduction of the $c_w$ coefficient of the respective projectile.

Numerous and extensive examinations of projectile arrangements of the type disclosed in the above cited German Offenlegungsschrift Nos. 3,127,002 and 32 07 220 and the corresponding U.S. patents brought surprising results which lead to the conclusion that there are interactions which were combined under the term aerodynamic coupling. Direct predetermination and utilization of the described separation jolt in conjunction with the measures for changing the $c_w$ coefficient of penetrator 80 and/or activator 50 then produced the aerodynamic coupling which was found to be particularly favorable for combatting actively and passively reacting special types of armor by means of kinetic energy projectiles.

If the diameter of activator 50 has a ratio of about 1:1 to that of penetrator 80, a stabilization guide assembly 132 can be completely omitted for the penetrator if a distance between the projectiles 50, 80 of less than one penetrator length shall be realized. The result is reduced dead weight and greater penetrating power. Breaking away of the guide assembly carrier with the resulting loss of some of the target-active mass of penetrator 80 is avoided.

Due to the aerodynamic coupling, any fish-tailing on the part of penetrator 80 dies down quickly. If, according to FIG. 4, an additional mechanical coupling is realized, the two go into increased interaction. Beginning with the escape of penetrator 80 from the turbulent drag of activator 50, for example due to fish-tailing of penetrator 80, the tip region 84 of the latter comes increasingly under the influence of the air coming in from the front. A beginning increase in the distance between the tail of activator 50 and the tip region 84 of penetrator 80 as well as the continued escape of the latter from the wake of activator 50 is counteracted not only by the aerodynamic restoring force but also by the mechanical restoring force of the additional coupling. The tension of torsion spring 106 increases under the pull of cable 102 opposite to the direction of fire S and finally results in cable 102 being partially wound up due to rotation of cable reel 107 in the direction of arrow 109 (see FIG. 4).

It will be understood that the above description of the present invention is susceptible to various modifications, changes and adaptations, and the same are intended to be comprehended within the meaning and range of equivalents of the appended claims.

What is claimed is:

1. Sabot-projectile arrangement adapted for being ejected from a gun barrel for the purpose of combatting actively and passively reacting armor, the sabot-projectile arrangement comprising:

first and second projectiles, each having a different coefficient of air resistance ($c_w$);

a discarding sabot comprised of segments which are discarded after the sabot-projectile arrangement leaves a gun barrel, the segments of said sabot defining a receptacle for accommodating said first and second projectiles with their longitudinal axes flush behind one another in order to follow one another in a spaced relationship on a common trajectory, with said first projectile leading said second projectile;

form locking means defining a form locking connection between said receptacle and each of said projectiles, with said form locking connection existing between the leading first projectile disposed in said receptacle and the segments of said sabot being released earlier than when said segments are separated from said second projectile after said sabot-projectile arrangement leaves a gun barrel;

delay means, disposed on said second projectile, for delaying said second projectile with respect to said first projectile when said segments are being separated for creating a desired distance between said two projectiles within narrow distancing limits within which there exists an axial aerodynamic coupling between said two projectiles, and wherein said axial aerodynamic coupling produces a correcting aerodynamic restoring force in the direction toward the trajectory of said leading first projectile, with said restoring force acting or said second projectile transversely to the longitudinal projectile axis of said second projectile; and actuatable means for varying the $c_w$ coefficient of at least one of said projectiles during flight, wherein actuation of said actuatable means causes the axial aerodynamic coupling between said projectiles to be maintained within said distancing limits.

2. Sabot-projectile arrangement as defined in claim 1, and further comprising: elastic mechanical coupling means for mechanically coupling said projectiles together, said elastic mechanical coupling means including a cable which is rolled up before said sabot-projectile-arrangement is fired from a gun barrel and which is unrolled during the trajectory of said projectiles for supporting the axial aerodynamic coupling between said projectiles and said correcting aerodynamic restoring force.

3. Sabot-projectile arrangement as defined in claim 2, wherein said elastic mechanical coupling means includes means for at least partially again rolling up said cable during the trajectory of said projectiles.

4. A sabot projectile arrangement as defined in claim 2 wherein said actuatable means and said elastic coupling means are independent of one another.

5. A sabot projectile arrangement as defined in claim 2 wherein said elastic coupling means includes means, including a reel on which said cable is initially wound, for producing a constantly increasing unwinding resistance to said cable.

6. A sabot projectile arrangement as defined in claim 5 wherein said actuatable means and said elastic coupling means are independent of one another.

* * * * *